US010858226B2

(12) United States Patent
Rabu

(10) Patent No.: US 10,858,226 B2
(45) Date of Patent: Dec. 8, 2020

(54) ELECTRIC WINCH CRANK

(71) Applicant: CHRYSADEV, Villeurbanne (FR)

(72) Inventor: Bruno Rabu, Villeurbanne (FR)

(73) Assignee: CHRSADEV, Villeurbanne (FR)

( * ) Notice: Subject to any disclaimer, the term of this patent is extended or adjusted under 35 U.S.C. 154(b) by 0 days.

(21) Appl. No.: 16/437,149

(22) Filed: Jun. 11, 2019

(65) Prior Publication Data

US 2019/0292027 A1 Sep. 26, 2019

Related U.S. Application Data

(63) Continuation of application No. 15/544,787, filed as application No. PCT/FR2016/050081 on Jan. 15, 2016, now Pat. No. 10,358,324.

(30) Foreign Application Priority Data

Jan. 20, 2015 (FR) ..... 15 50438

(51) Int. Cl.
*B66D 1/74* (2006.01)

(52) U.S. Cl.
CPC ..... *B66D 1/7478* (2013.01)

(58) Field of Classification Search
CPC ... B66D 1/7437; B66D 1/7478; B66D 1/7468
See application file for complete search history.

(56) References Cited

U.S. PATENT DOCUMENTS 4,290,584 A * 9/1981 Eckels ..... B66D 1/08 242/390.8

4,331,323 A * 5/1982 Sekimori ..... B60S 11/00 242/390.8

(Continued)

FOREIGN PATENT DOCUMENTS

ES 2311321 A1 2/2009
FR 2848201 A1 6/2001

(Continued)

OTHER PUBLICATIONS

International Search Report and Written Opinion issued by the International Searching Authority for PCT Application No. PCT/FR2016/050081 dated Mar. 14, 2016.

*Primary Examiner* — Emmanuel M Marcelo
(74) *Attorney, Agent, or Firm* — Heslin Rothenberg Farley & Mesiti P.C.

(57) ABSTRACT

The invention relates to an electric winch crank (1) comprising a main body (3) which includes an electric motor (32); a gripping handle (2) arranged at one end of the main body (3) and able to pivot on same with respect to said main body (3); coupling means (4) to a winch (100), arranged at the opposite end of said main body (3); a transmission mechanism driven by the output shaft of the motor (32) and enabling rotation of the coupling means (4); a mechanical reducer (34) interposed between the output shaft of the motor (32) and the coupling means (4), said crank further comprising a braking system (35) mounted on the output shaft of the motor (32); a control member (23) located on said gripping handle (2) for actuating said braking system (35) via said electronic circuit (31) and a rotating collector (29) comprising a first portion (291) rigidly attached to the gripping handle, connected to said control member, and a second portion (292) rigidly attached to the main body electrically connected to an electronic circuit.

10 Claims, 5 Drawing Sheets

(56) References Cited

U.S. PATENT DOCUMENTS

| | | | | | |
|---|---|---|---|---|---|
| 4,531,715 | A * | 7/1985 | Wiens | B66D 1/7431 | 254/266 |
| 5,386,970 | A * | 2/1995 | Trant | B25F 5/00 | 254/344 |
| 5,394,815 | A * | 3/1995 | Hansen | B25B 13/48 | 114/109 |
| 5,676,349 | A * | 10/1997 | Wilson | B66D 1/7468 | 242/395 |
| 5,863,028 | A * | 1/1999 | Dunsmore | B66D 1/7478 | 242/323 |
| 6,250,607 | B1 * | 6/2001 | Strom | B66D 1/12 | 254/342 |
| 6,705,597 | B1 * | 3/2004 | Reilly | B60P 7/0846 | 254/223 |
| 7,484,714 | B1 * | 2/2009 | Tsai | B66D 1/7463 | 254/343 |
| 2010/0012908 | A1 * | 1/2010 | Sjostedt | G05G 1/085 | 254/266 |

FOREIGN PATENT DOCUMENTS

| | | | |
|---|---|---|---|
| FR | 2833252 | A1 | 6/2003 |
| GB | 2317844 | A | 4/1998 |
| WO | 199403390 | A1 | 2/1994 |

* cited by examiner

ELECTRIC WINCH CRANK

TECHNICAL DOMAIN

The present invention relates to the technical domain of nautical equipment and particularly to accessories used on sailboats. More specifically it concerns an electric winch crank.

PRIOR ART

In general, a sailboat has one or more mechanisms referred to as a 'winch', i.e., winches around which a rope is wound/unwound in order, in particular, to trim sheets or hoist a sail. There are different types of cranks with which to maneuver these winches and in particular motorized cranks offering the operator the possibility of performing a maneuver either manually or in a motorized manner. By means of these cranks the operator who is passionate about sailing can also complete a maneuver manually and thus experience the associated sensations.

As described in the document FR 2,848,201, it is known to implement electric winch cranks, comprising a gripping handle, an electric motor powered by a battery together with a transmission mechanism driven by the output shaft of the motor and allowing for the rotation of the coupling means of the winch. A means of locking is known with which to switch the electric crank from a motorized mode to a manual mode and vice versa. In this case, the locking means are enabled/disabled by means of a control member, in this case a power button, which is located at the opposite end of the gripping handle of the crank.

However, this type of motorized crank can have some drawbacks. Indeed, during frequent maneuvers of trimming sheets, hoisting halyards, or even operating a windlass, during a manual maneuver the operator rotates the crank by pulling and pushing with both hands on the gripping handle, such as to exert maximum force. He often finds himself, arriving at the end of the exertion, in an uncomfortable position for which the stress on the muscles of the body is at a maximum.

Thus, the configuration of this type of electric crank forces the operator to withdraw one of his two hands from the gripping handle in order to actuate the control members and must therefore apply most of the significant forces with one hand.

Taking into account the fact that the average age of French amateur sailors who own a sailboat is around 60 years, the elimination of such forces would be advantageous in practicing safer sailing.

Another drawback of this type of crank resides in the absence of a control member with which to progressively adjust/control the rotation speed depending upon the type of maneuver.

Furthermore, in the document FR 2,833,252, a motorized crank is known comprising an electric motor together with a mechanical reducer and a gripping handle. The presence of a push button mounted on the fixed shaft of the handle is particularly described. This button, located on the handle, operates the motor. However, the control for the direction of rotation of the crank is located at away from the handle, in this case on the housing. The operator must therefore release the handle with one hand in order to work this control, thus losing time and precision, and imposing a greater effort on the operator.

This crank also includes a self-disengaging, anti-reverse system, located at the opposite end of the gripping handle which serves to facilitate the manual use thereof.

The amateur sailor wishing to complete the maneuver manually must first choose the direction of rotation of the self-disengaging, anti-reverse system, that is not located on the handle but rather at the end of the crank opposite the handle. Thus, as previously mentioned, the amateur sailor cannot perform a complete maneuver while keeping both hands on the gripping handle of the crank. On the contrary, one of the two hands is dropped from the handle in order to change the direction of rotation of the self-disengaging, anti-reverse lever. The maneuver cannot therefore be performed in a continuous manner, which in practice is a drawback.

Thus, on the market, there is currently no electric crank that makes it possible for an operator to perform a continuous maneuver while keeping both hands on the handle and wherein, in order to avoid awkward postures, all of the electrical controls are directly accessible to the fingers of the operator.

BRIEF DESCRIPTION OF THE INVENTION

One of the objectives of the invention is to facilitate the angular repositioning of the crank during frequent sail maneuvers by adding a control member that is directly accessible on the gripping handle and that allows activation of the braking system while keeping both hands on the gripping handle.

The object of the invention is to overcome the aforementioned disadvantages by proposing a winch crank comprising:

- a main body including an electric motor controlled by an electronic circuit;
- a gripping handle arranged at one end of the main body and able to pivot on same with respect to said main body;
- coupling means to a winch, arranged at the opposite end of said main body;
- a transmission mechanism driven by the output shaft of the motor and enabling rotation of the coupling means, said transmission mechanism comprising a mechanical reducer.

According to the invention, the winch crank is characterized in that a braking system is mounted on the output shaft of the motor. Thus, the braking system can act directly upon the motor during the transition from a manual to a motorized mode and vice versa.

Furthermore, the gripping handle comprises a control member able to generate commands intended for the electronic circuit for the activation of said braking system. This electronic circuit advantageously includes a microprocessor on an electronic card, and is located within the main body of the crank, being powered by a battery.

Such a crank also comprises a transmission mechanism comprising a first portion rigidly attached to the gripping handle which is connected to a control member, and a second portion, thereto, rigidly attached to the main body, electrically connected to an electronic circuit, allowing for the transmission of the commands generated by the control member during the rotation of the handle relative to the main body.

Thus, the transmission mechanism provides the transmission of the command, generated by the pressure exerted on the control member, to the integrated electronic circuit within the main body of the crank, even though the handle rotates upon itself with respect to this crank.

The transmission mechanism can be implemented in various ways, and can be either a rotating collector with sliding contacts, or a contactless mechanism of magnetically coupled coils, or even a radio communication system.

When the transmission mechanism is a rotating collector, the position and state of the various control members, whether dry contacts or potentiometers, are transmitted through the rotating collector directly to the electronic card that manages the actuation of the braking system and the motor.

When the transmission mechanism operates without contact, for example when using a pair of magnetically coupled coils, the physical magnitudes corresponding to the state of the control members are transmitted by electromagnetic induction. The transmission of these signals requires energy to allow for the shaping of these signals, and the magnetic coupling of these coils makes it possible to transmit electrical energy, from the main body containing the battery that is the electric energy source for the crank. In this case, a second microprocessor is present on a secondary electronic card that is placed within the gripping handle. This microprocessor is connected to control members in order to detect the positions thereof, and encodes an instruction generated by the actuation of a control member and sends it to the main electronic card present within the main body, by means of the rotary transmission mechanism functioning by means of induction. This transmission can be performed by inducing a modulated current in the coil that is integral with the rotating handle. As this coil is magnetically coupled to the coil that is integral with the main body, this modulated current is detected and decoded by the main card. Additionally, the main card, by means of the generation of an alternating voltage, and the modulation thereof, preferably within a remote frequency band, serves to transmit power from the main body to the secondary electronic card located within the gripping handle.

In another embodiment, the communication between the secondary card and main card could be completely wireless. In this case, each of the main and secondary cards is connected to or incorporates a circuit that encodes information to be transmitted and decodes information thought to be received. A person skilled in the art will be able to adapt the type of modulation depending upon the intended application and the physical magnitude to be transmitted. An independent energy source may be present with the secondary card, inside the gripping handle. This energy source can be renewable insofar as it is connected to a mechanism for collecting energy, for example solar energy, or mechanical energy by taking advantage of the movement of the gripping handle with respect to the main body.

Advantageously, the gripping handle may include an additional control member able to control the power supply to the electric motor.

In other words, this crank also makes it possible to adjust the rotation speed of the electric motor, directly from the handle, in order to facilitate and improve the performance of frequent maneuvers. Also in this case, the transmission mechanism guarantees optimal instruction transmission to the electronic circuit.

According to a specific implementation, the control members are positioned on the gripping handle, facing the positions of the fingers of the user when the latter grips the handle.

Thus, when using the electric crank, the pleasure sailor has direct and ergonomic access to the controls thus allowing for a reduction in maneuvering time. The pleasure sailor does not need to release the handle with one hand in order to actuate a button at the opposite end of said crank during a maneuver, which is thus performed in a continuous manner.

In practice, the braking system can be arranged in different ways compared to the electric motor.

Thus, in a first variant, the braking system may be arranged on an output shaft located on a first side of said motor, the mechanical reducer being connected to an output shaft of the motor emerging from the other side thereof.

Conversely, in another variant, the braking system may be arranged between the motor and the mechanical reducer.

Likewise, the output shaft of the electric motor can be arranged in various positions. In a first variant, the output shaft of the motor is mounted horizontally, that is to say along the longitudinal axis of the main body of the electric crank. The transmission mechanism then incorporates a bevel gear mechanism enabling the torque to be transmitted along a vertical axis.

In this case, the mechanical reducer can be directly mounted onto the output of the electric motor. In this case, the input shaft of the mechanical reducer rotates at the rotation speed of the output shaft of the electric motor. The bevel gear is then interposed between the mechanical reducer and the winch coupling means, which are oriented vertically.

In another embodiment, the mechanical reducer can also be mounted directly in line with the winch coupling means, with the shafts of the mechanical reducer therefore oriented vertically. The bevel gear is interposed between the motor and the reducer in order to connect the output shaft of the horizontally oriented electric motor to the input shaft of the mechanical reducer. With this bevel gear, the rotation speed of the input shaft of the mechanical reducer can also be reduced.

In a second variant, the output shaft of the motor is arranged vertically compared to the main body of the crank. In this case, the motor, the braking system and the reducer are all mounted in line with the winch coupling means. This particular arrangement makes it possible to reduce the mass of the crank and to concentrate the masses in line with the coupling means of the winch.

Advantageously, the crank may include a battery mounted on the main body in line with the coupling means. The operator, if the battery is discharged, can also manually complete the maneuver, then recharge the battery, or immediately replace the discharged battery with a fully charged battery, the latter being removable. The battery is recharged either on the boat from the internal DC electrical supply or AC supply when present, or later at the dock by connecting to the public AC grid. According to a preferred embodiment, the battery is wirelessly rechargeable, in particular by means of induction. In this case, the battery can also be recharged on the boat, especially when the handle is not in use and stowed on a base provided for this purpose. This base then includes an induction coil connected to a mechanism that makes it possible to generate from the source of electrical energy on the boat the AC voltage applied to this coil. This recharging can also be performed when docked using an induction charging mechanism. In other words, the battery can be removable or not, i.e., separable from or attached to the main body. It can be charged by a wired connection to a power source, or by means of being in proximity to a power source using the phenomena of induction.

Given the presence of watertight connections, the handle can also be used without the battery. In other words, in the case wherein the battery is absent, for example, because it is being recharged, the crank can be operated in a traditional manner, i.e. without mechanical assistance.

According to a specific embodiment, the battery is mounted at the opposite end of the gripping handle and protrudes in the extension of the main body thus forming a second grip zone. In this way, the operator carries the crank using these two grip zones and thus improves accuracy when coupling/uncoupling it to the capstan of the winch.

Advantageously, the braking system is initially locked at rest. At rest is defined as the state wherein the rotation-speed control member is not active.

In other words, without other action, the braking system prevents the electric motor from turning due to mechanical friction, such that the crank can be used manually.

Advantageously, the braking system may include continuous and smooth friction surfaces that enable locking, regardless of the position of the various components of the transmission mechanism.

Moreover, the handle includes a control member that provides for the locking/unlocking of said crank within the winch drum. When the control member is activated, the user can then engage the crank coupling means with those of the winch. Once the crank engages with the winch, the user can then release the member and the crank is then locked.

BRIEF DESCRIPTION OF FIGURES

The invention will be well understood and further characteristics and advantages of the invention will become apparent from the description provided below, which is for reference only and is in no way restrictive, with reference to the accompanying figures, wherein:

FIGS. 5*a* and 5*b* are views of below the end of the crank of FIG. 2, respectively before and after connection into the winch capstan;

For simplification, parts or elements of an implementation that are found in an identical or similar way in another implementation will be identified by the same numerical references and will not be described again.

DETAILED DESCRIPTION

As can be seen from the aforementioned, the invention relates to an electric winch crank 1 of a design that is simple and comfortable for the user.

Figure 1:
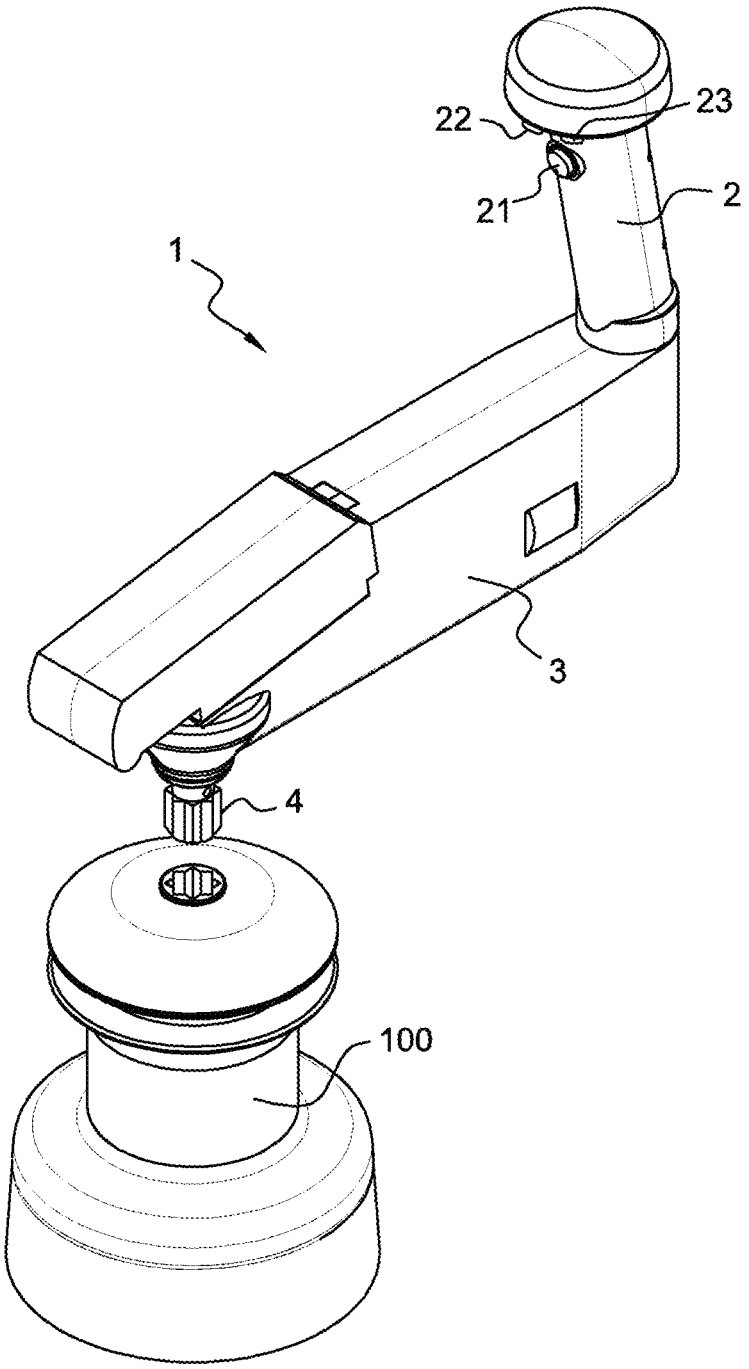
FIG. 1 is a summary perspective view of an electric crank shown according to an embodiment of the invention, ready to be engaged with a winch capstan.

As shown in FIG. 1, the electric winch crank 1 has a gripping handle 2 located at one end of a main body 3 and coupling means 4 located at another end of the main body 3 allowing for the connection of the crank 1 with the capstan of a winch 100.

Figure 2:
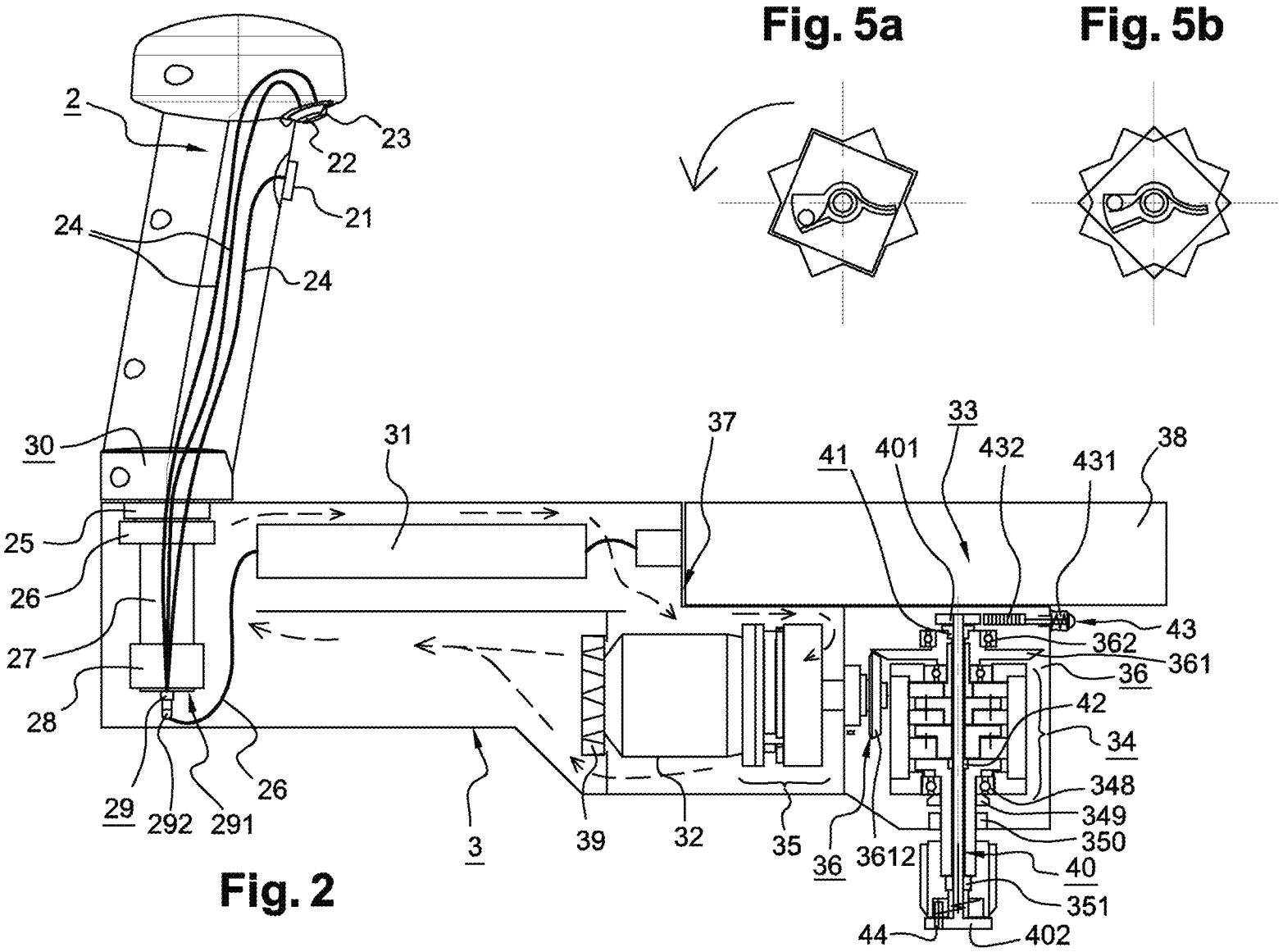
FIG. 2 is a longitudinal section view of the handle of FIG. 1.

As shown in FIG. 2, the gripping handle 2 comprises three control members 21, 22, 23 located facing the positions of the fingers of the operator when the latter grips the handle. Such an arrangement makes it possible to guarantee the operator quick and simple access during frequent maneuvers. In this case, the control members 21, 22, 23 are push-buttons or knobs that incorporate potentiometers and/or switches. The rotation speed of the motor 32 relative to the winch is adjusted with the control member 21. The control member 22 acts on the direction of rotation of the motor 32, the braking system 35 is unlocked with the control member 23.

In a configuration that is not shown in the figures, the handle can comprise two control members. The speed and direction of rotation of the motor is adjusted with a first control member, which is a midpoint potentiometer. With a further control member the braking system can be unlocked, particularly for an angular adjustment of the crank during frequent maneuvers.

In the embodiment shown in the figures, the control members are shown in a configuration intended to facilitate the understanding of the invention, but in practice, in order to meet ergonomic goals, they can be positioned in other areas on the handle of the crank.

As shown in FIG. 2, these control members 21, 22, 23 are connected to electrical connection wires 24 that pass through a hollow shaft 27 in order to be connected to a rotating collector 29.

The gripping handle 2 is attached to the main body 3 of the crank using a hollow shaft 27 that emerges from the lower part 30 of the handle 2 and allows for the coupling together of the shells of the handle 2. A joint seal 25 is mounted around the hollow shaft 27 near the junction between the handle 2 and the main body 3 of the crank 1. Bearings 26, 28 are mounted on the hollow shaft 27, below the joint seal 2, in order to allow for rotation of the handle 2 relative to the main body 3 of the crank 1. A rotating collector 29 is also mounted at the lower end of the hollow shaft 27.

This rotating collector 29 is composed of two parts. The first part of 291 is rigidly attached to the hollow shaft 27 and the second part 292 is rigidly attached to the main body 3 of the crank 1. The electrical connection wires 26, emerging from the second portion 292 are directly connected to the electronic circuit 31 housed with the main body 3 of the crank 1. The role of the rotating collector 29 is to ensure good electrical transmission when the operator calls on at least one of the control members is operated by. During a frequent maneuver, given that the gripping handle 2 turns on itself relative to the main body 3, the rotating collector 29 makes it possible to transfer the states of the control members, that are movable relative to the body of the crank, and to thus avoid the wires in turn coming to wind on themselves thereby deteriorating and/or disconnecting from the control members and/or the electronic circuit.

Figure 6:
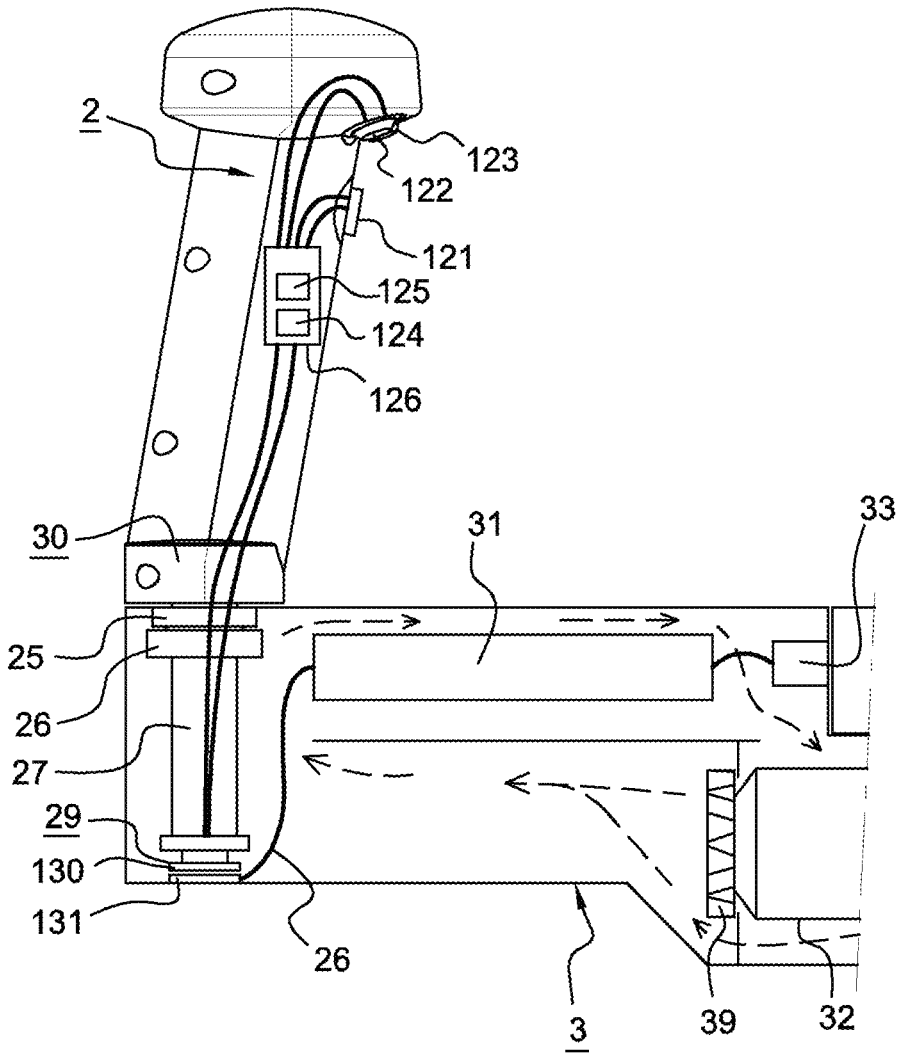
FIG. 6 is a similar view to FIG. 2 of an embodiment of the rotary transmission mechanism, operating by induction.

In the variant shown in FIG. 6, the handle 2 is equipped with an electronic card 124, which is connected on the one hand to the control members 121, 122, 123, and on the other hand to the coil 130 of the rotary transmission mechanism 121, that itself has a second coil 131 magnetically coupled to the coil 130. This coil 131 is fixed, and itself electrically connected to the motor-operation management electronic card 31. Conversely, the coil 130 is rigidly attached to the rotating handle 2, and the movements relative to the two coils 130, 131 allow for the passage of signals and electrical power from one coil to the other. Thus, the states of the various control members 121, 122, 123 are encoded by the microprocessor 125 located on the card 124, for which the power supply is provided by a circuit 126. This circuit 126, which can be a bank of capacitors, or a rechargeable battery, is supplied with energy by the main battery 33, by means of alternating signals that are sent by the main card 31 to the coil 131. Electrical energy can be delivered to the rechargeable battery circuit 126 by the coupling of this coil 131 to the rotating coil 130. At the same time, the microprocessor 125 generates signals, by injecting a modulated current that circulates in the coil 130, and is thus transmitted by inductive coupling to the coil 131 and therefore to the microprocessor of the main electronic card 131 which is thus informed of the states of the various control members 121, 122, 123.

As shown in FIG. 2, the main 3 body extends longitudinally from the gripping handle 2 to the coupling means 4 of the winch. Thus, it includes the main mechanical and electrical elements, that are the electronic circuit 31, the electric motor 32, the interchangeable battery 33, the mechanical reducer 34, the braking system 35 and the bevel gear mechanism 36.

The electric motor 32 is a low current electric motor, specifically a "brushless" motor with a power of between 450-700 W, more preferably of a power of nearly 500 W. Depending upon the requirements, the electric motor could of course be a direct current motor. The control member 21, controls the rotation speed of the electric motor 32 of the crank 1.

In practice, the battery 33 can easily be detached from the electric crank 1 by means of a sliding-type connection system that is conventional in portable electrical equipment. Thus, replacement of the battery is simple and quick.

Moreover, the battery 33 is housed within a recess 37 of the main body 3 at the end of the gripping handle 2 with a part protruding in the extension of said main body 3 such as to form a second grip zone 38. This second grip zone 38 is useful especially when the operator carries the crank 1 in order to engage it with the capstan 100 of the winch.

Moreover, the presence of the push button 43 under the battery 33 presents an ergonomic advantage for the user who gets an easy access to the locking/unlocking system.

Figure 3:
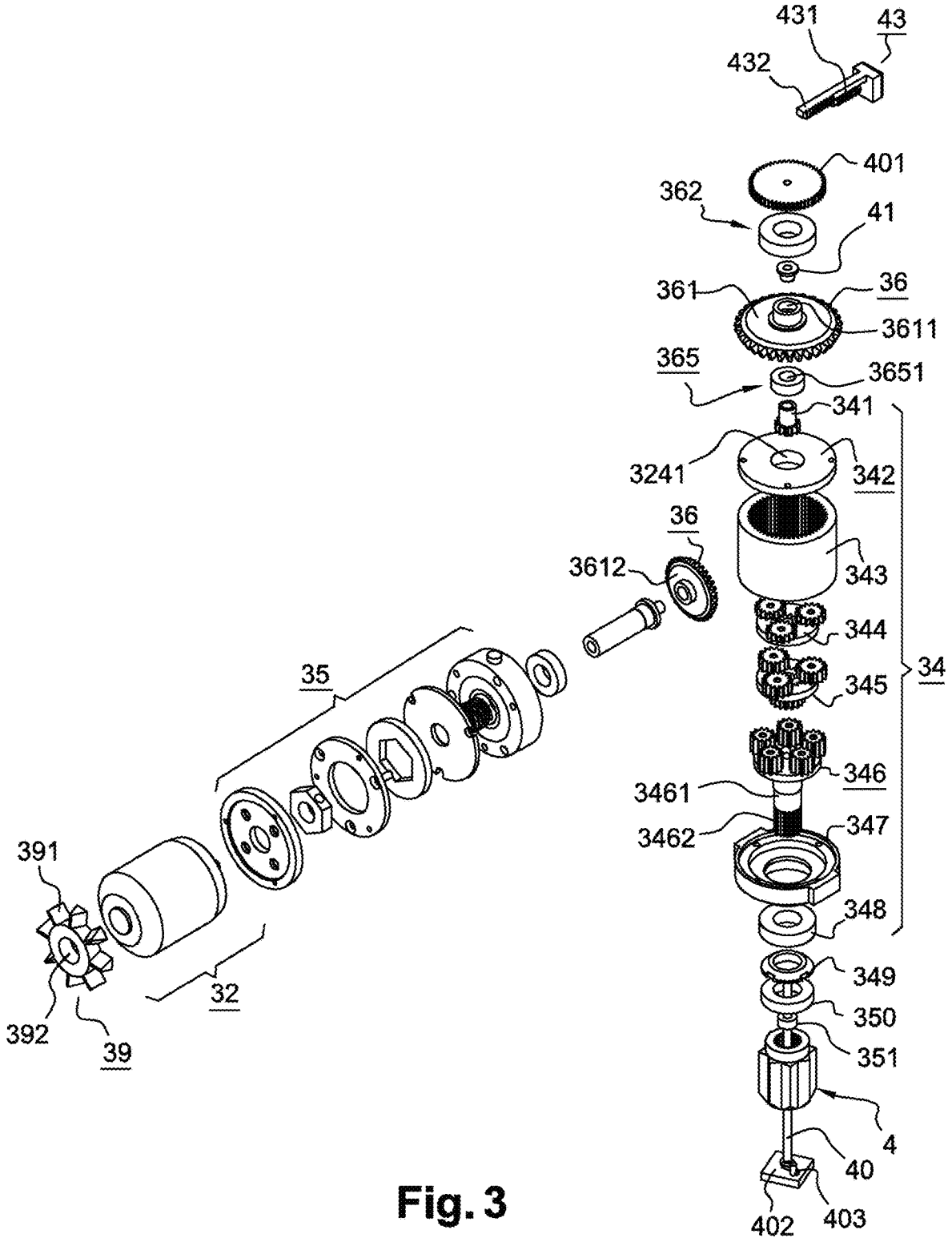
FIG. 3 is a summary perspective exploded view of the electric motor assembly, the transmission mechanism and the braking system of the crank of FIG. 2.

As shown in FIGS. 2 and 3, a ventilation system 39, is mounted on the output shaft of the motor 32.

According to a first embodiment, this ventilation system 39 particularly comprises blades 391 and an opening 392 in which the output shaft of the motor 32 is engaged. When the motor 32 turns, the ventilation system 39 and more particularly the rotation of these blades 391, leads to the evacuation of heat by means of air circulation within the volume of the main body 3. The heat is discharged to the outside through the main body 3 of the crank 1. The heat generated by the electronic circuit 31 can also be evacuated by this ventilation system 39. Because of the presence of a lubrication system 139 on the hollow shaft carrying the bevel gear 36, and the mechanical reducer 34, circulation of the ventilation system must if possible, be avoided within this area of the crank 1.

According to a second embodiment, the ventilation system is an electric fan which has the advantage of operating independently of the motor, because it is preferably controlled by the electronic circuit 31. Thus, this type of fan makes it possible on the one hand to guarantee the circulation of air within the main body and to do so independently of the rotation speed of the motor. On the other hand, it allows heat to be evacuated even after stopping the motor in such a way as to continuously reduce the temperature within the main body.

The crank can also comprise a thermal diffusion mechanism embedded within the circulation circuit, with the aim of improving the removal of heat within the main body. According to the application, this thermal diffusion mechanism may comprise a set of fins or a plate made of a metallic material, typically of aluminum molded onto the body of the crank, such as to evacuate the heat captured by the diffusion mechanism into the ventilation flow.

Means of sealing, not shown in the figures, such as joint seals, flat seals, O-rings or otherwise, are provided at each of the mechanical and electrical connections.

The crank may also include a power switch, not shown within the figures, in order to stop or limit current consumption when the crank is not used or not operating in an electrical assistance mode. In a preferred embodiment, this switch is mechanically coupled to the control member for locking/unlocking the crank within the winch. Such that, when the user begins a crank coupling or uncoupling maneuver on the winch, the control electronics are activated, then deactivated after a period of non-use.

A visual, LED or other type of signaling mechanism may also be integrated for the purpose of warning the operator about any possible excessive rise in temperature within the main body of the crank, thereby leading to damage thereto.

As shown in FIG. 2, the mechanical reducer 34 is located directly in line with the coupling means 4 of the crank 1. In this case, a bevel gear 36 is then interposed between the electric motor 32 and mechanical reducer 34. A greater amount of torque can be delivered to the mechanical reducer 34 with the bevel gear 36.

As shown in FIG. 3, a bevel gear mechanism 36, in this case a bevel or spiral bevel gear 36, makes it possible to provide the engagement between the motor output shaft 32 and the input shaft 341 of the mechanical reducer 34 located directly in line with the coupling means of the winch 100. The bevel gear 36 includes two pinions 361 and 3612. The pinion 361 has fewer teeth than the pinion 3612, cooperating thereby with the output shaft of the motor 32, in such a way to increase the torque at the output of the bevel gear 36. The input pinion 341 is mechanically coupled to the pinion 361 of the mechanical reducer 36.

A first bearing 362 is mounted between the pinion 361 and the main body 3. This first bearing 362 allows for the rotation of the bevel gear 36.

A first self-lubricating ring 41 is mounted on the pinion 361 in such a way as to facilitate the movement of the rotary shaft 40 within the bevel gear 36.

A second bearing 365 is present on the other side of the pinion 361, facing the mechanical reducer 34. This second bearing 365 allows for the rotational guiding of the shaft 341 relative to the mechanical reducer 34.

The mechanical reducer 34 is formed by an assembly of elements 341-351 forming a planetary gearset. The mechanical reducer 34 comprises in particular an input planetary gear 341 that is guided by the bearing 365 and rigidly attached to the bevel gear 36. This input planetary gear 341 passes through a mounting plate 342, fixed relative to the mechanical reducer 34 input shaft and comprises an opening passage 3421. The mounting plate 342 is rigidly attached to an external planetary gear 343 which comprises a system of internal teeth engaging with the first reduction level of the mechanical reducer 34.

The mechanical reducer 34 comprises a set of three reduction levels 344, 345, 346. The first reduction level 344 includes a satellite carrier 3441 supporting three satellites 3442 on the surface facing the mounting plate 342. These three satellites 3442 mesh with the input planetary gear 341. The other face of the satellite carrier 344 comprises a planetary gear 3443 oriented facing the second reduction level and intended to drive the satellites of the satellite carrier 345. In a similar or derivative manner, the second reduction level is implemented in such a way that the desired torque is supplied at the output of the third reduction level 346 and more particularly to the coupling means 4 of the crank 1.

The output shaft 3461 at the reduction level 346 constitutes the output shaft of the mechanical reducer 34 and therefore rotates at the reduced speed imposed by the three reduction levels 344, 345 and 346 and the bevel gear 36. The output shaft 3461 passes through the output plate 347 that closes the mechanical reducer 34. A bearing 348, mounted within the output plate 347, allows for the rotation of the shaft 3461.

The mechanical junction between the output shaft 3461 and the coupling means 4 of the crank 1 is guaranteed by the mechanical elements 349, 350 and 351. A lock-nut 349 is screwed onto the output shaft 3461 of the mechanical reducer 34 and locks the inner ring of the bearing 348 onto the satellite carrier of the third reduction level 346. A seal 351 makes it possible to ensure sealing at the connection between the output shaft and the rotary shaft 40. A seal 350 ensures the seal between the shaft 3461 and the main body 3. The output shaft 3461 has a splined end 3462 that complements the internal splines of the coupling means 4 of the crank 1 Thus, the rotational movement of the output shaft 3461 is transmitted to the coupling means 4 of the crank 1.

As shown in FIG. 2, a rotary shaft 40 extends all the way along the vertical part of the crank 1 and passes, respectively, through the bevel gear 36, the hollow shaft mechanical reducer 34 together with the coupling means 4 of the crank 1.

The first portion 401 of the rotary shaft 40 is a toothed wheel that is made to rotate by means of a push button 43 when the crank 1 is intended to be locked within the winch 100. The mechanism for locking the crank 1 within the winch 100 is described below.

A first self-lubricating ring 41 is provided between the rotary shaft 40 and the upper part of the bevel gear mechanism 36 in order to facilitate movement of the shaft 40 relative to the bevel gear 36. A second self-lubricating ring 42 also facilitates movement of the rotary shaft 40 at the output of the third reduction level 346 which passes through the output plate 347 of the mechanical reducer 34.

The rotary shaft 40 has a first portion 401 at the upper end thereof with which the shaft 40 is held within the mechanical reducer 34.

A second portion 402 located at the opposite end of the rotary shaft 40 particularly serves to come lock/fix the crank 1 within the capstan of the winch 100.

The rotary shaft 40, in the initial position thereof, does not allow the coupling means 4 of the crank to come latch in the winch 100. In effect, the portion 402, intended to come lock the crank 1 within the winch 100, is oriented and kept in position by means of a restoring spring 403, in such a way that it prevents the insertion of coupling means 4 of the crank 1 within the winch 100, as shown in FIG. 5*b*.

A push button 43 is present facing the portion 401. When the operator presses the push button 43, the spring 431 is compressed and the rack 432 which is rigidly attached to the push button 43 causes rotation of the portion 401, and therefore the rotary shaft 40. In a variant, not shown, the push button can be replaced by an electric switch controlling an electromagnet which actuates the rack.

This movement drives a rotation through a set angle, most preferably an angle of 22.5°. This rotational movement is possible due to the hollow shaft of the mechanical reducer 34. The portion 402 undergoes the same fixed angle rotation which makes it possible to adopt a position allowing the insertion of the couplings means 4 into the winch 100.

This portion 402 finds itself, as shown in FIG. 5*a*, in a position known as "open", i.e., aligned with the teeth of the coupling means 4 of the crank 1.

When the operator releases the push button 43, the spring 431 is then decompressed, the pinion 401 returns to the initial position thereof and the assembly of parts 401, 40, 402 resumes the initial angular position thereof, called the locked position as shown in FIG. 5*b*. The combined effect of the action of the restoring spring 403 and a mechanical abutment system of the part 44 allows for the return to the initial position of the elements 401, 40, 402. The crank 1 is thus locked onto the winch 100.

According to an embodiment not shown in the figures, a safety system preventing the push button from being actuated as soon as the motor is controlled can be implemented for example by means of a locking electromagnet. This safety feature may also be implemented by means of an escapement mechanism for the rack in case of locking the part 401.

A second variant of the invention is shown in FIG. 3, the mechanical reducer 70 is formed by an assembly of elements 51-57 forming a planetary gearset. The mechanical reducer 70 comprises in particular an input planetary gear 51 directly connected to the end of the output shaft of the motor 32. This input planetary gear 51 passes through a mounting plate 52, that is fixed to the motor 32, and provided with an opening for passage 521 of the output shaft of the motor 32. The mechanical reducer 70 comprises a system of three reduction levels 53, 54, 55. The reduction level 53 includes a satellite carrier 532 supporting three satellites 531 on the surface facing the mounting plate 52. These three satellites 531 mesh with the planetary gear 51. The other face of the satellite carrier 532 comprises a planetary gear 533 oriented facing the second reduction level and intended to drive the satellites 541 of the satellite carrier 542. In a similar or derivative manner, the two other reduction levels are implemented in such a way that the desired torque is supplied at the output of the mechanical reducer 70 and more particularly to the bevel gear mechanism 60. The outer planetary gear 56 comprises a system of internal teeth complementary to the satellites of the third reduction level 55. The outer planetary gear 56 is attached to a collar 57. The collar 57 is a stationary output plate of the mechanical reducer 70 which on the one hand, allows the mechanical connection to the third reduction level 55 and on the other hand, due to the lateral lugs 571, blocks the rotation of the outer planetary gear 56. The collar 57 is coupled to the input pinion 59 of the bevel gear mechanism 60. The collar 57 and the pinion 59 are secured by pins 58 inserted into the openings 572. The output pinion 601 of the bevel gear mechanism 60 is located in line with the coupling means 4 of the winch 100. The ratio of the number of teeth between the input pinion 591 and the output pinion 601 thus makes it possible to provide the necessary torque and a reduced rotation speed to the winch 100.

According to another embodiment, not shown in the figures, the mechanical reducer, the electric motor and the braking system are all mounted directly in line with the coupling means of the winch. Such a configuration makes it possible to eliminate the presence of a bevel gear and in so doing an overall reduction in the mass of the crank. Furthermore, the entire mass is found to be in line with the coupling means of the winch.

Figure 4:
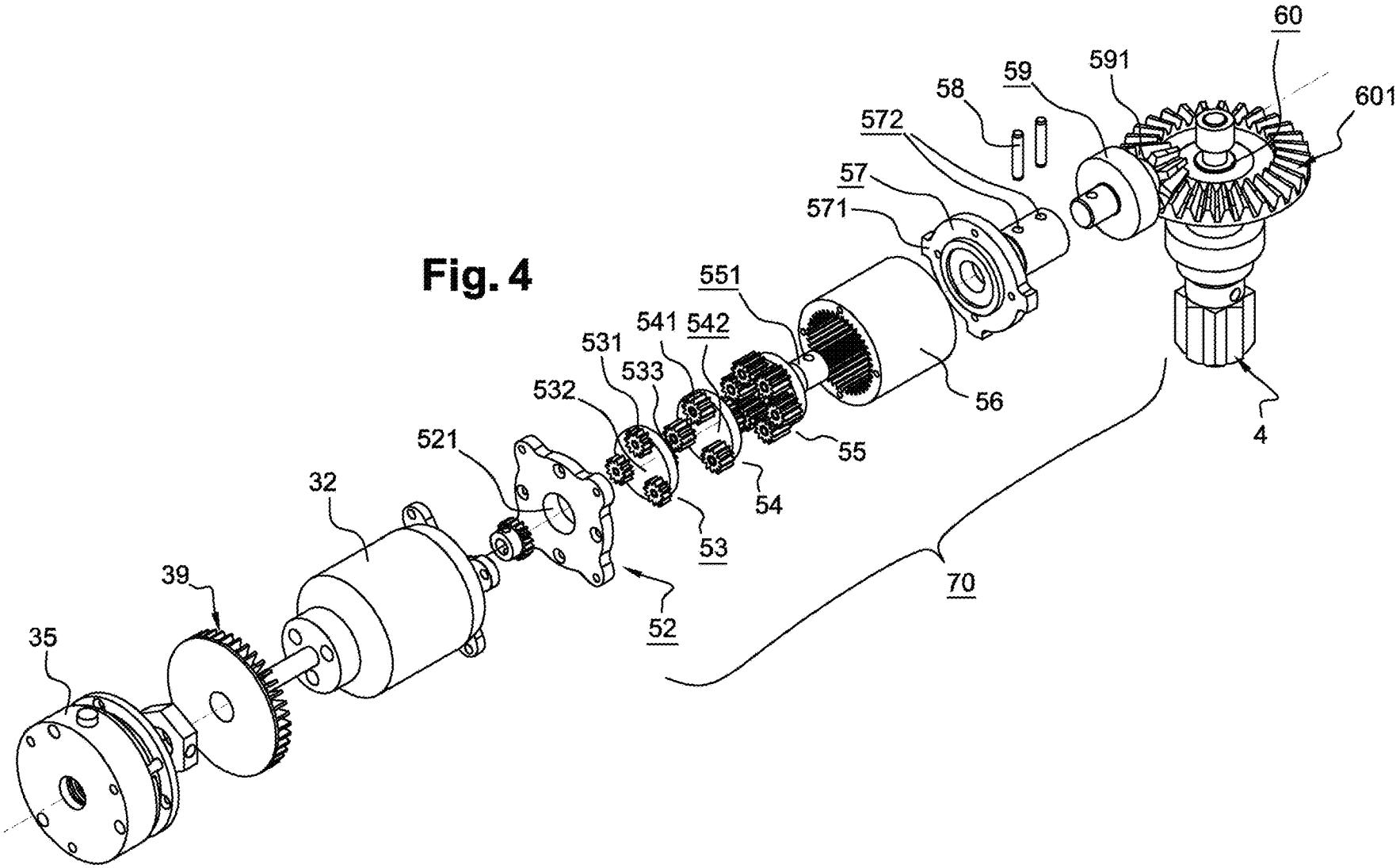
FIG. 4 is a summary perspective exploded view of the electric motor assembly, the transmission mechanism and the braking system of an embodiment of the invention.

As shown in FIG. 4, the braking system comprises several interacting members 351-354. An electromagnet mechanism 355, in particular comprising a spring 3551, is coupled to a first movable flange 354. The braking system 35 also comprises a brake lining 353 which has a central recess 3531 into which a drive nut 351 of complementary shape is inserted. The drive nut 351 is directly secured to the output shaft of the motor and allows for the rotation of the brake lining 353. A second fixed flange 352 is arranged on the other side of the brake lining 353 with respect to the first flange 354. At rest, when the electromagnet is deactivated, the spring 3551 is then decompressed and the first flange 354 is brought into contact with the brake lining 353. The first flange 354 thus pushes the brake lining 353 against the second flange 354 due to the latitude of movement imparted by the shape of the nut 351 compared to the central recess of the brake lining 353. Thus, the fixed flange 352 and movable flange 354 engage and lock the nut 351-brake lining 353 system. The braking system thus prevents the output shaft of the motor 32 from turning.

When the crank is operating in motorized mode, the braking system 35 is "unlocked". In this case, the electromagnet 355 is powered and the spring 3551 is then compressed. The first movable flange 354 is no longer in contact with the nut 351-brake lining 353 system. The brake lining 353 can thus rotate according to the rotation speed of the output shaft of the electric motor 32. Of course, other system architectures can be envisaged.

The crank according to the invention can operate in different modes.

Firstly, the operator latches the crank 1 onto the capstan of the winch 100. The possible presence of a locking system allows the crank to remain rigidly attached to the winch during frequent maneuvers.

When the operator decides to use the crank 1 according to a motorized mode, the control member 22 is pressed thereby fixing the direction of rotation of the electric motor 32, the rotation speed is then set by pressing the control 21. At the moment that the operator exerts pressure on the control member 21 for controlling the rotation speed, the braking system 35 is then automatically released by the electrical circuit 31. The operator maintains pressure on the control member 21 and terminates the maneuver in a completely motorized manner.

For an operator wishing to manually terminate the maneuver, it is sufficient for him to release the control member 21 and the braking system 35 is then once again locked, thus preventing the electric motor 32 from turning. The operator can thus manually perform the maneuver by manually rotating the crank.

In some cases, the operator may find himself in an uncomfortable and less ergonomic position which does not allow him to move the handle easily. Thus, the configuration of the invention makes it possible to reposition the crank such as to complete the operation under better conditions. To do so, the subsequent steps are followed:

- Activate the control member 23 controlling the braking system 35 in order to unlock it;
- Reposition the crank in a more suitable angular position by maintaining the pressure exerted on the control member 23; and
- Release the control member 23 in order to re-lock the output shaft of the electric motor 32;
- End the maneuver manually.

In any case, the arrangement of the electric crank allows the operator to perform the aforementioned manipulations simply and quickly.

It can be seen from the above that an electric crank according to the invention has many advantages, and in particular:

- By the arrangement thereof it principally allows for direct access to those control members controlling speed and direction of rotation as well as the release of the braking system;
- It makes it possible to manually readjust the angular position thereof with respect to the winch during frequent sailing maneuvers;
- It allows for a considerable reduction in the mass of the elements constituting the electric crank;
- It allows for the angular repositioning of the crank with respect to the winch in a single step, without having to remove it from the winch.

The invention claimed is:

1. An electric winch crank comprising:
- a main body having an electric motor controlled by an electronic circuit;
- a gripping handle positioned at one end of the main body and pivotable at the one end relative to the main body;
- a coupling means to a winch, positioned at an opposite end of the main body;
- a transmission mechanism driven by an output shaft of the electric motor and allowing rotation of the coupling means; and
- a mechanical reducer interposed between the output shaft of the electric motor and the coupling means, wherein
- the transmission mechanism comprises a bevel gear mechanism and a hollow shaft mechanical reducer;
- wherein the electric winch crank further comprises a mechanism for locking the electric winch crank within a capstan of the winch, the mechanism for locking the electric winch crank comprising:
  - a rotary shaft passing through the bevel gear mechanism, the hollow shaft mechanical reducer and the coupling means, the rotary shaft having a first portion formed by a toothed wheel disposed at an upper end of the rotary shaft and a second portion located at the opposite end of the rotary shaft, the second portion being moveable between two positions, wherein the two positions comprise:
  - an open position, wherein said second portion is aligned with a set of teeth of the coupling means; and
  - a closed position, wherein the second portion is angularly shifted with the set of teeth of the coupling means;
  - a rack coupled with the first portion of the rotary shaft in order to move the second portion in the open position when the rack is actioned; and
  - a restoring spring configured to move the second portion in the closed position.

2. The electric winch crank of claim 1, wherein the displacements of the rotary shaft between the open and closed positions are made with an angle of 22.5°.

3. The electric winch crank of claim 1, wherein the electric winch crank further comprises a push button to control a displacement of the rack to move the second portion in the open position.

4. The electric winch crank of claim 3, wherein the electric winch crank further comprises a safety system preventing the push button from being actuated as soon as the electric motor is controlled.

5. The electric winch crank of claim 4, wherein safety system is realized by an electromagnet.

6. The electric winch crank of claim 1, wherein the electric winch crank further comprises an electric switch controlling an electromagnet, wherein the electromagnet controls a displacement of the rack to move the second portion in the open position.

7. The electric winch crank of claim 1, wherein the electric winch crank further comprises a first self-lubricating ring mounted between the rotary shaft and thean upper part of the bevel gear mechanism.

8. The electric winch crank of claim 1, wherein the mechanical reducer is comprised of a planetary gearset.

9. The electric winch crank of claim 8, wherein the mechanical reducer includes at least one of a first, a second and a third reduction level.

10. The electric winch crank of claim 9, wherein a self-lubricating ring is mounted in the third reduction level.

* * * * *